US010112390B2

(12) United States Patent
Fricke et al.

(10) Patent No.: US 10,112,390 B2
(45) **Date of Patent: *Oct. 30, 2018**

(54) PIEZOELECTRIC FLUID EJECTION ASSEMBLY

(71) Applicant: HEWLETT-PACKARD DEVELOPMENT COMPANY, L.P., Houston, TX (US)

(72) Inventors: Peter J. Fricke, Corvallis, OR (US); Andrew L. Van Brocklin, Corvallis, OR (US); Scott A. Linn, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/822,348

(22) Filed: Nov. 27, 2017

(65) Prior Publication Data

US 2018/0072059 A1 Mar. 15, 2018

Related U.S. Application Data

(63) Continuation of application No. 15/307,208, filed as application No. PCT/US2014/035998 on Apr. 30, 2014, now Pat. No. 9,855,746.

(51) Int. Cl.

| | |
|---|---|
| ***B41J 2/14*** | (2006.01) |
| ***B41J 2/045*** | (2006.01) |
| ***B41J 2/155*** | (2006.01) |

(52) U.S. Cl.

CPC ..... *B41J 2/14209* (2013.01); *B41J 2/04581* (2013.01); *B41J 2/04588* (2013.01);
(Continued)

(58) Field of Classification Search

CPC ..... B41J 2/155; B41J 2202/19–2202/21; B41J 2/14209; B41J 2/04588; B41J 2/04581; B41J 2/14072

See application file for complete search history.

(56) References Cited

U.S. PATENT DOCUMENTS

| | | | |
|---|---|---|---|
| 7,396,108 | B2 | 7/2008 | Siiverbrook |
| 7,600,836 | B2 | 10/2009 | Masuda |

(Continued)

FOREIGN PATENT DOCUMENTS

| | | |
|---|---|---|
| JP | H06-127034 | 5/1994 |
| JP | 2003-300318 | 10/2003 |

(Continued)

OTHER PUBLICATIONS

Kim et al.; Development of Inkjet Nozzle Driven by Double Piezo Actuators; 15th International Symposium on Flow Visualization, Jun. 25-28, 2012, pp. 1-7.

*Primary Examiner* — Juanita D Jackson
(74) *Attorney, Agent, or Firm* — HP Inc.-Patent Department

(57) ABSTRACT

In some examples, a piezoelectric fluid ejection assembly includes a micro-electro mechanical system (MEMS) die including a plurality of nozzles, a first application-specific integrated circuit (ASIC) die electrically connected to the MEMS die, and a second ASIC die electrically connected to the MEMS die. The first ASIC die includes a plurality of driver amplifiers for respective nozzles of a first number of the plurality of nozzles, and a plurality of unique waveform data generators to generate respective different waveforms for activating the nozzles of the first number of the plurality of nozzles.

20 Claims, 5 Drawing Sheets

(52) U.S. Cl.
CPC ..... *B41J 2/14072* (2013.01); *B41J 2/155* (2013.01); *B41J 2202/20* (2013.01)

(56) References Cited

U.S. PATENT DOCUMENTS

| | | | |
|---|---|---|---|
| 7,712,854 | B2 | 5/2010 | Ou et al. |
| 7,794,047 | B2 | 9/2010 | Drake et al. |
| 8,596,762 | B2 | 5/2013 | Huffman et al. |
| 9,855,746 | B2 * | 1/2018 | Fricke ..... B41J 2/14209 |
| 2009/0051733 | A1 | 2/2009 | Drake et al. |
| 2010/0201291 | A1 | 8/2010 | Cheiky et al. |
| 2011/0115852 | A1 | 5/2011 | Bibl et al. |
| 2012/0092399 | A1 | 4/2012 | Chen et al. |
| 2013/0106961 | A1 | 5/2013 | Van Brocklin et al. |
| 2014/0192118 | A1 | 7/2014 | Cruz-Uribe et al. |

FOREIGN PATENT DOCUMENTS

| | | |
|---|---|---|
| JP | 2008-197512 | 8/2008 |
| JP | 2011-520670 | 7/2011 |
| JP | 2014-069448 | 4/2014 |
| WO | WO-2013032472 | 3/2013 |
| WO | WO-2013032475 A1 | 3/2013 |
| WO | WO-2013085543 | 6/2013 |
| WO | WO-2013165335 | 11/2013 |

* cited by examiner

PIEZOELECTRIC FLUID EJECTION ASSEMBLY

CROSS REFERENCE TO RELATED APPLICATIONS

This is a continuation of U.S. application Ser. No. 15/307,208, having a national entry date of Oct. 27, 2016, U.S. Pat. No. 9,855,746, which is a national stage application under 35 U.S.C. § 371 of PCT/US2014/035998, filed Apr. 30, 2014, which are both hereby incorporated by reference in their entirety.

BACKGROUND

Fluid-jet printing devices can eject fluid onto media, such as paper. The fluid can be ejected in accordance with a desired image to be formed on the media. Different fluid-jet technologies include piezoelectric and thermal inkjet technologies. Piezoelectric printing devices employ membranes that deform when electric energy is applied. The membrane deformation causes ejection of fluid. Thermal inkjet printing technologies, by comparison, employ heating resistors that are heated when electric energy is applied. The heating causes ejection of the fluid.

DETAILED DESCRIPTION

Examples of the present disclosure provide piezoelectric printhead assemblies and methods. The piezoelectric printhead assemblies disclosed herein can help to provide increased nozzle density, increased reliability, increased image quality, and/or increased printing speed, as compared to other piezoelectric printers, among other advantages.

Piezoelectric printing is a form of drop-on-demand printing where a drop, e.g., a drop of ink, is ejected from a nozzle of a die when an actuation pulse is provided to the nozzle. For piezoelectric printing an electrical drive voltage, e.g., the actuation pulse, is provided to a piezoelectric material of the die, which deforms to eject the drop from the nozzle.

Other piezoelectric printers may have a linear, e.g., one dimensional, array of nozzles located on a micro-electro mechanical die. These other piezoelectric printers may utilize a high power waveform amplifier that is located away from the micro-electro mechanical die because the amplifier generates heat. That is, the viscosity of the fluids utilized for piezoelectric printing is affected by temperature and temperature fluctuations, such as fluid heating caused by transferred amplifier heat, can reduce image quality. For instance, a rise in temperature of the fluid utilized for piezoelectric printing due to transferred waveform amplifier heat can cause undesirable drop size variation and/or undesirable placement of drops on the media. For these other piezoelectric printers, a drive waveform may be sent to a drive multiplexer that is coupled to the one dimensional array of nozzles located on the micro-electro mechanical die by a flex interconnect. As mentioned, the piezoelectric printhead assemblies disclosed herein can help to provide increased nozzle density, increased reliability, increased image quality, and/or increased printing speed, as compared to other piezoelectric printers.

Figure 1:
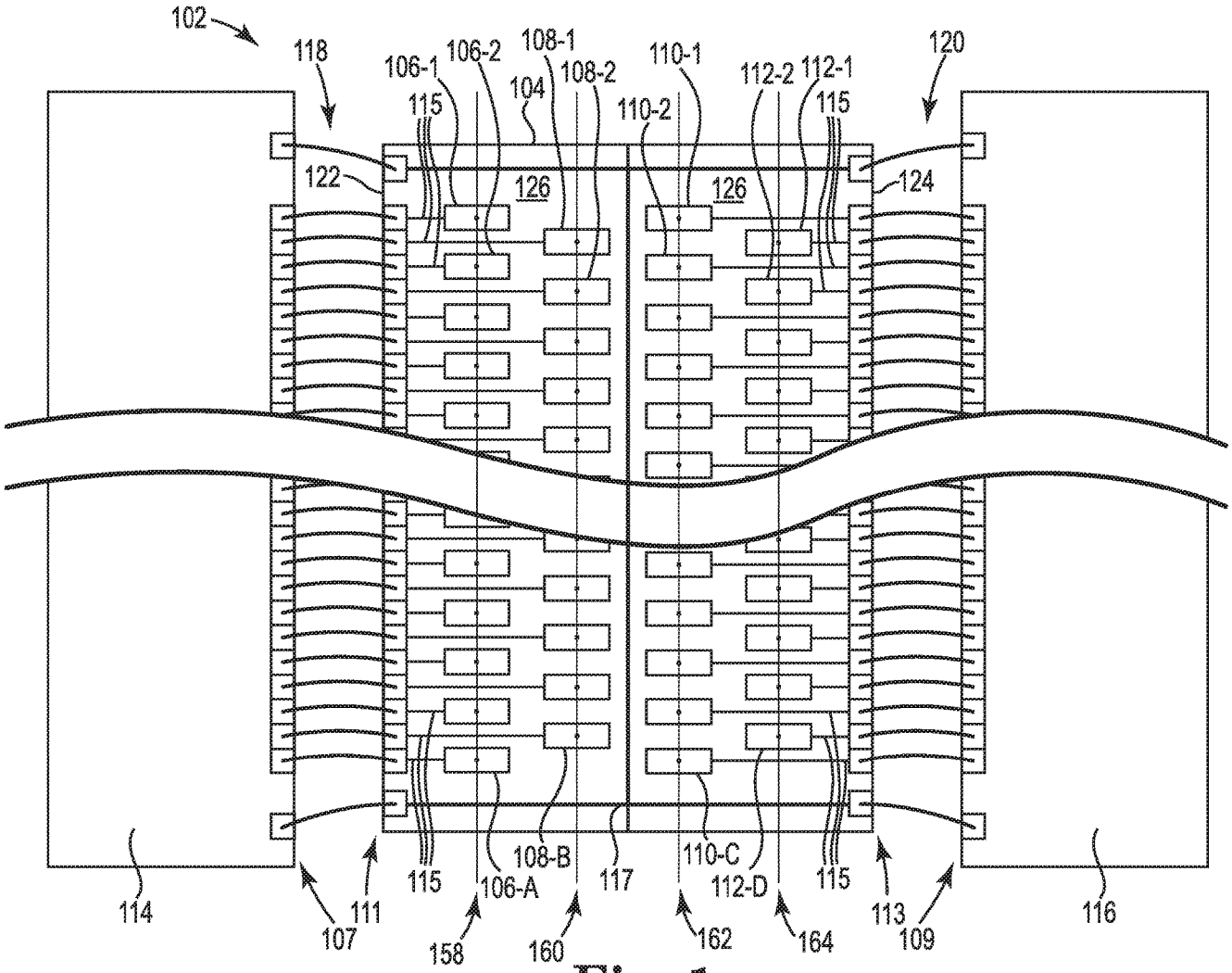
FIG. 1 illustrates a portion of a piezoelectric printhead assembly in accordance with one or more examples of the present disclosure.

FIG. 1 illustrates a portion of a piezoelectric printhead assembly 102 in accordance with one or more examples of the present disclosure. The piezoelectric printhead assembly 102 can include a micro-electro mechanical system (MEMS) die 104, which may also be referred to as a printhead die. The MEMS die 104 can include a number of piezoelectric materials 106-1, 106-2, . . . , 106-A, 108-1, 108-2, . . . , 108-B, 110-1, 110-2, . . . , 110-C, 112-1, 112-2, . . . , 112-D. A, B, C, and D are each independently an integer value. Some examples of the present disclosure provide that A, B, C, and D each have an equal integer value; however, examples of the present disclosure are not so limited.

As shown in FIG. 1, the piezoelectric materials 106-1, 106-2, . . . , 106-A can be associated with a first column 158 of nozzles; the piezoelectric materials 108-1, 108-2, . . . , 108-B can be associated with a second column 160 of nozzles; the piezoelectric materials 110-1, 110-2, . . . , 110-C can be associated with a third column 162 of nozzles; and the piezoelectric materials 112-1, 112-2, . . . , 112-D can be associated with a fourth column 164 of nozzles. Each particular nozzle can have a number of piezoelectric materials associated therewith. For instance, an actuation pulse may be provided to a number of piezoelectric materials to eject a drop from a particular nozzle.

The piezoelectric printhead assembly 102 can include a first application-specific integrated circuit (ASIC) die 114 and/or a second ASIC die 116. Some examples of the present disclosure provide that the first ASIC die 114 and the second ASIC die 116 have a single design. For instance, the first ASIC die 114 and the second ASIC die 116 can have the same configuration, e.g., prior to ASIC dies 114 and 116 being coupled to MEMS die 104. As such, advantageously a single type of ASIC die can be fabricated for the piezoelectric printhead assembly 102. In other words, prior to ASIC dies 114 and 116 being coupled to MEMS die 104 the ASIC dies 114 and 116 are interchangeable. Examples of the present disclosure provide that one of the ASIC dies 114 and 116 is rotated 180 degrees relative to the other ASIC die and is located transverse the MEMs die 104 relative to that ASIC die. For instance, the first ASIC die 114 can be coupled to a first side of MEMs die 104 and the second ASIC die 116 can be rotated one hundred eighty degrees relative to the first ASIC die 114 and be coupled to a second side of the MEMs die 104.

As shown in FIG. 1, the first ASIC die 114 is coupled to the MEMS die 104 by a plurality of wire bonds 118. Also, as shown in FIG. 1, the second ASIC die 116 is coupled to the MEMS die 104 by a plurality of wire bonds 120. The wires utilized for wire bonds 118 and wire bonds 120 can include a metal such as gold, copper, aluminum, silver, palladium, or alloys thereof, among others. The wires utilized for wire bonds 118 and wire bonds 120 can have a diameter in a range from 10 microns to 100 microns. Forming the wire bonds 118 and the wire bonds 120 can include ball bonding, wedge bonding, compliant bonding, or combinations thereof, among others.

As shown in FIG. 1, the first ASIC die 114 can include a plurality of wire bond pads 107, the second ASIC die 116 can include a plurality of wire bond pads 109, the MEMS die 104 can include a first plurality of wire bond pads 111, and the MEMS die 104 can include a second plurality of wire bond pads 113. The plurality of wire bond pads 107 and the first plurality of wire bond pads 111 may be utilized to couple the first ASIC die 114 to the MEMS die 104 with the plurality of wire bonds 118. Similarly, the plurality of wire bond pads 109 and the second plurality of wire bond pads 113 may be utilized to couple the second ASIC die 116 to the MEMS die 104 with the plurality of wire bonds 120.

As shown in FIG. 1, MEMS die 104 can include a plurality of traces 115. The plurality of traces 115 of traces may be utilized to couple the first plurality of wire bond pads 111 to the piezoelectric materials associated with the first column 158 of nozzles and the second column 160 of nozzles and couple the second plurality of wire bond pads 113 to the piezoelectric materials associated with the third column 162 of nozzles and the fourth column 164 of nozzles. As shown in FIG. 1, MEMS die 104 can include a ground 117. Each of the piezoelectric materials associated with the first column 158 of nozzles, the second column 160 of nozzles, the third column 162 of nozzles, and the fourth column 164 of nozzles can be coupled to the ground 117.

The MEMS die 104 can include a first side 122 and a second side 124. Some examples of the present disclosure provide that the first side 122 and/or the second side 124 are perpendicular to a rear face 126 of the MEMS die 104. Some examples of the present disclosure provide that the first side 122 and/or the second side 124 are perpendicular to a shooting face, discussed further herein, of the MEMS die 104. Some examples of the present disclosure provide that the rear face 126 and the shooting face are parallel to one another.

As illustrated in FIG. 1, the first ASIC die 114 is adjacent, e.g., proximate to, the first side 122 of the MEMS die 104 and the second ASIC die 116 is adjacent to the second side 124 of the MEMS die 104. Locating the first ASIC die 114 and the second ASIC die 116 adjacent to the respective sides of the MEMS die 104 can help to accommodate a wire bond density, discussed further herein, associated with one or more examples of the present disclosure.

Some examples of the present disclosure provide that the first ASIC die 114, the MEMS die 104, and the second ASIC die 116 do not overlie one another; e.g., the first ASIC die 114 does not overlie the MEMS die 104 or the second ASIC die 116; the MEMS die 104 does not overlie the first ASIC die 114 or the second ASIC die 116; and the second ASIC die 116 does not overlie the first ASIC die 114 or the MEMS die 104. For instance, a planar cross section of the MEMS die 104 that is perpendicular to the first side 122 of the MEMS die and the second side 124 of the MEMS die 104 can be entirely located between the first ASIC die 114 and the second ASIC die 116.

Utilizing the wire bonds 118 and the wire bonds 120 to respectively couple the first ASIC die 114 and the second ASIC die 116 to the MEMS die 104 can help to provide an increased nozzle density. Utilizing the wire bonds 118 and the wire bonds 120 to respectively couple the first ASIC die 114 and the second ASIC die 116 to the MEMS die 104 can quadruple a nozzle density as compared to other piezoelectric printers that a utilize flex interconnect to couple a multiplexer to a die. The flex interconnects cannot meet the interconnect density required to have a nozzle density of the piezoelectric printhead assemblies disclosed herein, which, as mentioned, utilize wire bonds.

Figure 2:
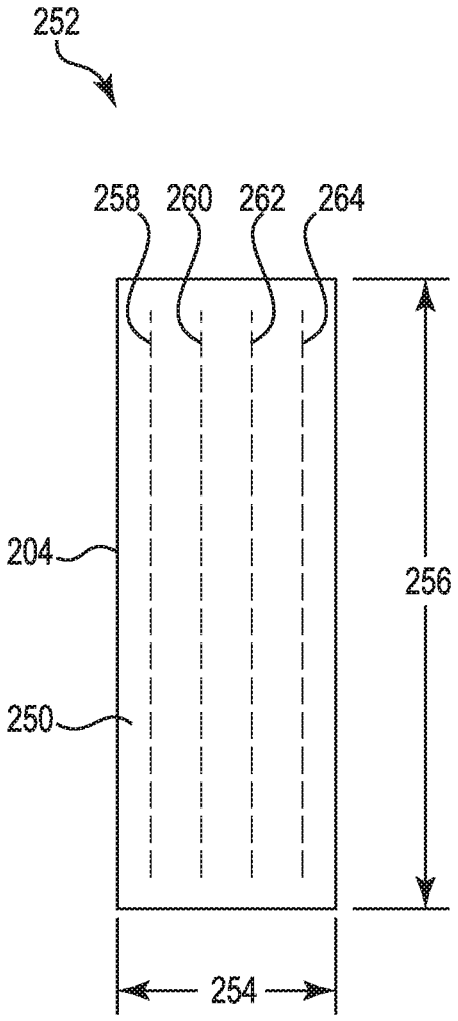
FIG. 2 illustrates a portion of a micro-electro mechanical system die in accordance with one or more examples of the present disclosure.

FIG. 2 illustrates a portion of a MEMS die 204 in accordance with one or more examples of the present disclosure. As shown in FIG. 2, the MEMS die 204 can include a shooting face 250 and a plurality of nozzles 252. Examples of the present disclosure provide that the plurality of nozzles 252 can be arranged in a two dimensional array. As shown in FIG. 2, the plurality of nozzles can extend in a crosswise direction 254 of shooting face 250 and extend in a longitudinal direction 256 of shooting face 250. Some examples of the present disclosure provide that the MEMS die 204 can include a first column 258 of nozzles, a second column 260 of nozzles, a third column 262 of nozzles, and a fourth column 264 of nozzles. While FIG. 2 shows four columns of nozzles extending the longitudinal direction 256, examples of the present disclosure are not so limited. Some examples of the present disclosure provide that the MEMS die 204 has a nozzle density of at least 1200 nozzles per inch; however, examples of the present disclosure are not so limited.

Figure 3:
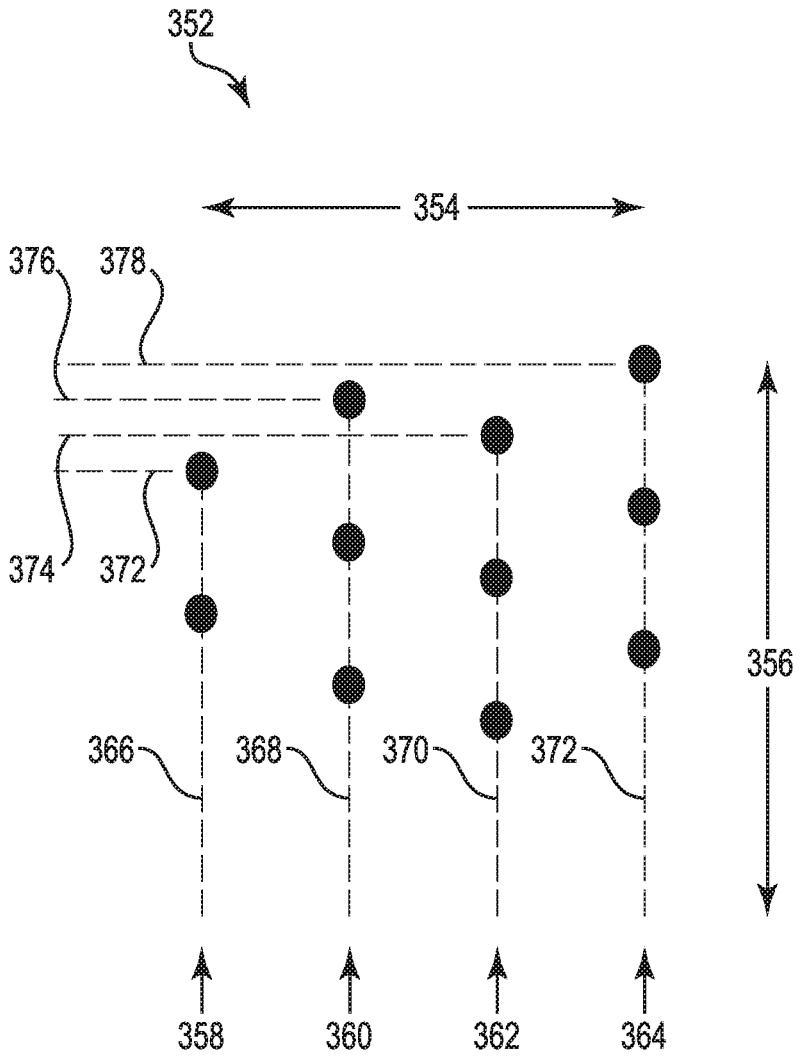
FIG. 3 illustrates a portion of a plurality of nozzles in accordance with one or more examples of the present disclosure.

FIG. 3 illustrates a portion of a plurality of nozzles 352 in accordance with one or more examples of the present disclosure. As mentioned, the plurality of nozzles 352 can extend in a crosswise direction 354 and can extend in the longitudinal direction 356.

As shown in FIG. 3, nozzles in a first column 358 can be associated with a longitudinal axis 366, nozzles in a second column 360 can be associated with a longitudinal axis 368, nozzles in the a third column 362 can be associated with a longitudinal axis 370, and nozzles in a fourth column 364 can be associated with a longitudinal axis 372. Some examples of the present disclosure provide that the longitudinal axis 366 can be separated from the longitudinal axis 368 by a distance in a range from 0.0466 hundredths of an inch to 0.0500 hundredths of an inch; the longitudinal axis 368 can be separated from the longitudinal axis 370 by a distance in a range from 0.0600 hundredths of an inch to 0.0667 hundredths of an inch, and the longitudinal axis 370 can be separated from the longitudinal axis 372 by a distance in a range from 0.0466 hundredths of an inch to 0.0500 hundredths of an inch.

As shown in FIG. 3, nozzles in the first column 358 can be associated with a crosswise axis 372, nozzles in the second column 360 can be associated with a crosswise axis 376, nozzles in the third column 362 can be associated with a crosswise axis 374, and nozzles in the fourth column 364 can be associated with a crosswise axis 378. Some examples of the present disclosure provide that the crosswise axis 372 can be separated from the crosswise axis 374 by a distance in a range from 0.0004 hundredths of an inch to 0.0033 hundredths of an inch; the crosswise axis 374 can be separated from the crosswise axis 376 by a distance in a range from 0.0004 hundredths of an inch to 0.0033 hundredths of an inch, and the crosswise axis 376 can be separated from the crosswise axis 378 by a distance in a range from 0.0004 hundredths of an inch to 0.0033 hundredths of an inch.

Figure 4:
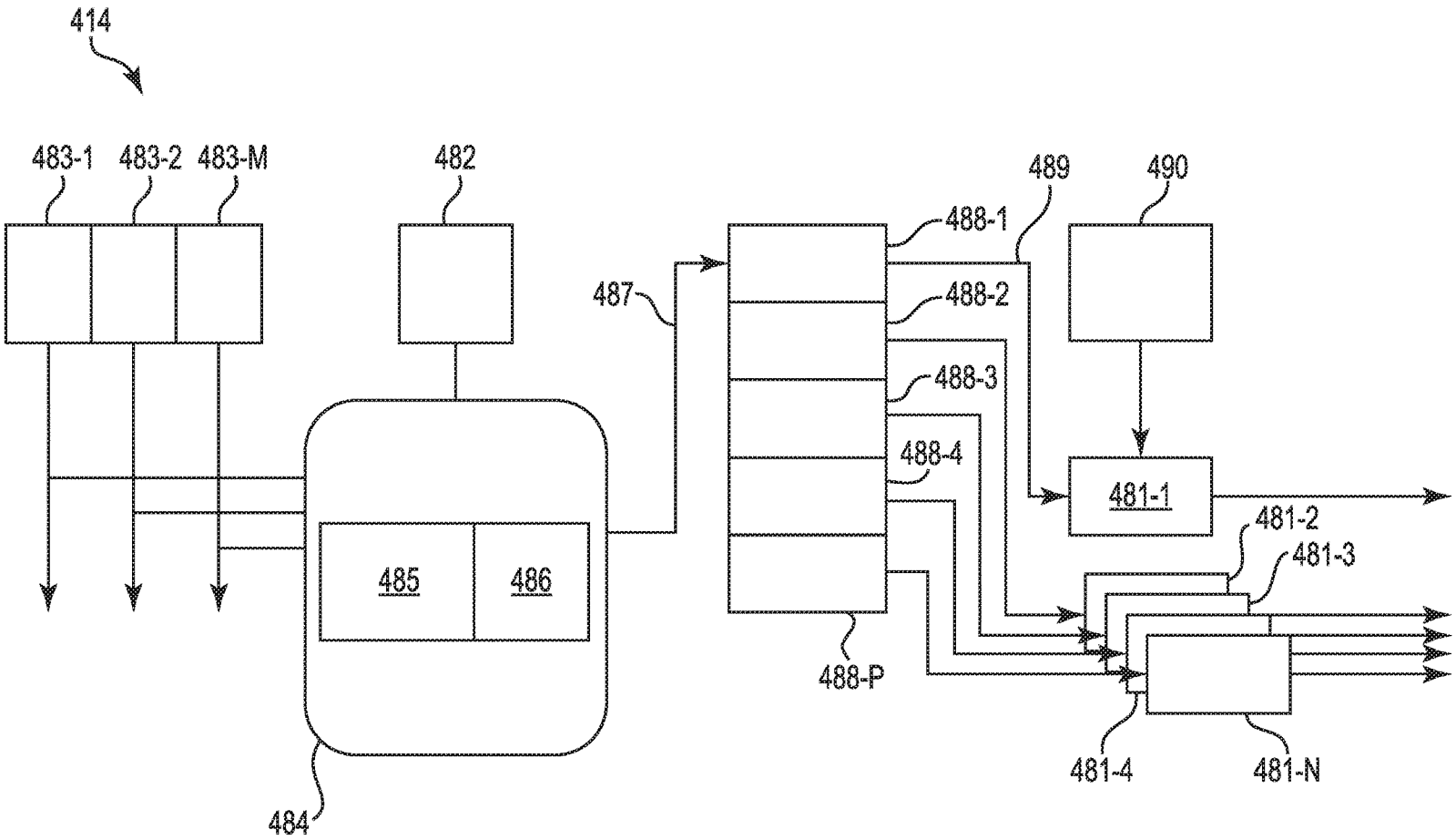
FIG. 4 illustrates components of an ASIC in accordance with one or more examples of the present disclosure.

FIG. 4 illustrates components of an ASIC die 414 in accordance with one or more examples of the present disclosure. As mentioned, of the present disclosure provide that a first ASIC die and a second ASIC die, e.g., the first ASIC die 114 and the second ASIC die 116 as illustrated in FIG. 1, can have a single design. As such, a second ASIC die can the same components as the ASIC die 414 illustrated in FIG. 4.

The ASIC die 414 can include a number of driver amplifiers 481-1, 481-2, 481-3, 481-4, . . . , 481-N, where N is an integer value. For instance, N can have a value equal to one half of a number of nozzles of a MEMS die to which the ASIC die 414 is wire bonded to. In some examples, a total number of a first plurality of wire bonds e.g., those coupling a ASIC die to a MEMS die can be equal to a total number of a second plurality of wire bonds. For instance, a MEMS die having 1056 nozzles can be coupled to a first ASIC die, e.g., ASIC die 414, and a second ASIC die, e.g., ASIC die 116; as such the first ASIC die can include 528 driver amplifiers and the second ASIC die can also include 528 driver amplifiers. In other words the ASIC die 414 controls a first half of the nozzles of a MEMS die and a second ASIC die controls a second half of the nozzles of the MEMS die.

Fluid ejected from the nozzles, e.g., ink, can be sensitive to thermal variation. For instance, a change of one degree Celsius can cause print defects due to undesirable drop size variation and/or undesirable placement of drops on the media. As mentioned, the ASIC dies, e.g., the first ASIC die 114 and the second ASIC die 116 as shown in FIG. 1, are wire bonded to a MEMS die. Because the ASIC dies are wire bonded to the MEMS die, the ASIC dies are located proximate, e.g., close to, the MEMS die. To help reduce print defects the driver amplifiers 481-1, 481-2, 481-3, 481-4, . . . , 481-N can be low power amplifiers. Utilizing low power amplifiers can help provide that fluid maintains a constant temperature, e.g., the fluid temperature does not increase by one degree Celsius or more due to heat generated by the driver amplifiers. Examples of the present disclosure provide that the driver amplifiers 481-1, 481-2, 481-3, 481-4, . . . , 481-N have a constant bias power dissipation in a range from 0.5 milliwatts to 3.0 milliwatts. Some examples of the present disclosure provide that the driver amplifiers 481-1, 481-2, 481-3, 481-4, . . . , 481-N have a constant bias power dissipation of 1.0 milliwatts.

The ASIC die 414 can include rest voltage component 482. The rest voltage component 482 can provide that nozzles which are not firing are maintained at a constant voltage, e.g., a rest voltage. The ASIC die 414 can include a number of arbitrary waveform data generators 483-1, 483-2, . . . , 483-M, where M is an integer value. Some examples of the present disclosure provide that M is in a range from 16 to 32; however, examples of the present disclosure are not so limited.

The ejection of fluid from a nozzle can be influenced by a drive waveform that is used to deflect the piezoelectric material corresponding to that nozzle. Drive waveforms can have different voltages, widths, and/or shapes that can be varied to provide different drop characteristics, such as drop weight and velocity, among others. Different drive waveforms, e.g., digital streams generated by different arbitrary waveform data generators 483-1, 483-2, . . . , 483-M, may each correspond to a unique combination of voltage, pulse width, time delay, and/or shape. ASIC die 414 can include a number of storage components, e.g., RAM, associated with the arbitrary waveform data generators 483-1, 483-2, . . . , 483-M that can store voltage values, e.g., voltage values generated by arbitrary waveform data generators 483-1, 483-2, . . . , 483-M.

Some examples of the present disclosure can provide for individual nozzle control and/or waveform generation. The ASIC die 414 can include a conditioner unit 484. The conditioner unit 484 can receive digital input, e.g., from the number of arbitrary waveform data generators 483-1, 483-2, . . . , 483-M and the rest voltage component 482.

The conditioner unit 484 can include a selector 485. The selector 485 can select an available drive waveform, e.g., a waveform provided by an arbitrary waveform data generator 483-1, 483-2, . . . , 483-M. Waveform selection can be based upon current pixel data, future pixel data, past pixel data, and/or calibration data, a number of which may be provided to the selector. For instance, the selector 485 may utilize a two bit data protocol for specifying if a specific arbitrary waveform will be selected for a particular nozzle. As an example, "00" may indicate rest; "01" may indicate selection of a single drop waveform for firing; "10" may indicate selection of a double drop waveform for firing; and "11" may indicate selection of a triple drop waveform for firing. Other configurations are possible, for instance "01" may indicate selection of a double drop waveform, and so forth. Current pixel data can correspond to "0" or "1" for a present firing cycle, past pixel data can correspond to pixel times that have already occurred, and future pixel data can correspond to a pixel that has not yet occurred.

Further, the conditioner unit 484 can include a scaler 486. The scaler 486 can scale, e.g., alter, drive waveform data sent from arbitrary waveform data generators 483-1, 483-2, . . . 483-M that are destined for each respective nozzle that the ASIC die 414 controls, e.g., a first half of the all of the nozzles of a MEMS die. A scaling value can be determined for each nozzle of the MEMS die. For instance, each nozzle of the MEMS die can be calibrated, e.g., to determine variances due to manufacturing and/or processing tolerances. This calibration, e.g., of each nozzle, can be used to determine the scaling value. This calibration can be performed periodically, e.g., daily, and/or per use, e.g., per print job, among others. The ASIC die 414 can store the scaling value for each respective nozzle that the ASIC die 414 controls. Waveforms sent from the arbitrary waveform data generators 483-1, 483-2, . . . , 483-M to each respective nozzle that the ASIC die 414 controls can be scaled with the scaling value; e.g., an amplitude of the waveform data can be multiplied by the scaling value to provide scaled voltage data values for a particular nozzle. The conditioner unit 484 can provide an output 487, such as a digital stream including conditioned voltage data values, e.g., a voltage that has been selected and/or scaled.

The ASIC die 414 can include a number of digital-to-analog converters 488-1, 488-2, 488-3, 488-4, . . . , 488-P, where P is an integer value. For instance, P can have a value equal to one half of a number of nozzles of a MEMS die to which the ASIC 414 is wire bonded to. For instance, there can be a respective digital-to-analog converter for each nozzle that the ASIC die 414 controls. Each of the number of digital-to-analog converters 488-1, 488-2, 488-3, 488-4, . . . , 488-P can receive a respective stream, such as output 487, and convert digital portions of the stream to analog output 489. A respective analog output, e.g., analog output 489, can be sent to a respective driver amplifier, e.g., driver amplifier 481-1.

The ASIC die 414 can include a control sequencer 490. The control sequencer 490 can store and can provide analog data, e.g., a fire cycle sequence corresponding to the operation of the amplifier, for each of the respective driver amplifiers 481-1, 481-2, 481-3, 481-4, . . . 481-N. For instance, a fire cycle can begin with the control sequencer 490 resetting drive circuits for each respective nozzle that the ASIC die 414 controls. Amplifier control data, e.g., that is stored by the control sequencer 490, can be loaded for each respective nozzle that the ASIC die 414 controls. Amplifier calibration data per nozzle can also be loaded for each respective nozzle that the ASIC die 414 controls. Selected and/or scaled waveforms can be loaded for nozzles that are firing in a particular firing cycle and non-firing nozzles can be driven at the rest voltage.

Similarly, a second ASIC die can include a number of components of the ASIC die 414. As such, the individual nozzles, e.g., each nozzle of the MEMS die, can be advantageously individually controlled with a unique waveform generated at each nozzle.

Figure 5:
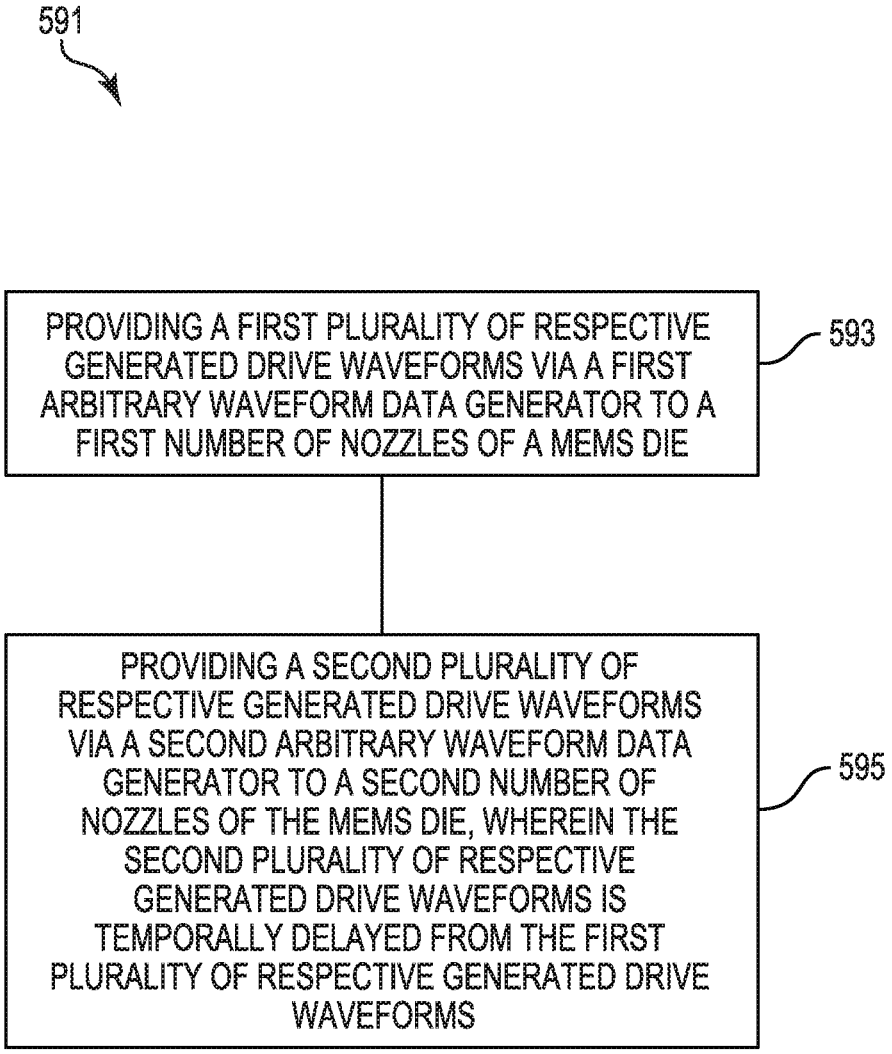
FIG. 5 illustrates a block diagram of an example of a method according to the present disclosure.

FIG. 5 illustrates a block diagram of an example of a method 591 according to the present disclosure. The method 591 may be utilized for reducing a peak current. The firing a particular nozzle has an associated power requirement, e.g., a current. When a plurality of nozzles are fired simultaneously a peak current, e.g., a sum of the associated power utilized for each of the respective plurality of nozzles, can be realized.

At 593, the method 591 can include providing a first plurality of respective generated drive waveforms via a first arbitrary waveform data generator to a first number of nozzles of a MEMS die. The first plurality of respective generated drive waveform data can correspond to ejection of fluid from the first number of nozzles of the MEMS die.

At 595, the method 591 can include providing a second plurality of respective generated drive waveforms via a second arbitrary waveform data generator to a second number of nozzles of the MEMS die, wherein the second plurality of respective generated drive waveforms is temporally delayed from the first plurality of respective generated drive waveforms. The second plurality of respective generated drive waveform data can correspond to ejection of fluid from the second number of nozzles of the MEMS die.

Some examples of the present disclosure provide that the first plurality of respective generated drive waveform data are generated by a first arbitrary waveform data generator of a first application-specific integrated circuit wire bonded to the MEMS die. Some examples of the present disclosure provide that the second plurality of respective generated drive waveform data are generated by a first arbitrary waveform data generator of a second application-specific integrated circuit wire bonded to the MEMS die.

The piezoelectric printhead assemblies disclosed herein can eject multiple drops per pixel. As such, generated drive waveforms, e.g., corresponding to a voltage, can include a number of pulses where each pulse corresponds to the ejection of a single drop of fluid from a respective nozzle. For example, a drive waveform having four pulses per pixel will eject four drops for that pixel. As an example, a pulse can have a pulse width of approximately 1 microsecond.

Examples of the present disclosure provide that each pulse can include a falling portion and a rising portion. For the falling portion of a pulse, current can be supplied from a low voltage supply, e.g., a low voltage supply coupled to a respective driver amplifier to provide a transient current. For the rising portion of the pulse, current can be supplied from a high voltage supply, e.g., a high voltage supply coupled to the respective driver amplifier to provide a transient current. Some examples of the present disclosure provide that the low voltage supply is a five volt supply and the high voltage supply is a thirty volt supply.

As mentioned, examples of the method can be utilized for reducing peak current according to the present disclosure. The method can include temporally delaying a plurality of drive waveform data from a number of other pluralities of drive waveform data.

Some examples of the present disclosure provide that the temporal delay can correspond to completion of the falling portion of a pulse of a preceding drive waveform. For instance, a first plurality of drive waveform data can be utilized for ejecting a first number of respective ink drops from a MEMS die and a second plurality of drive waveform data can be utilized for ejecting a second number of respective ink drops from the MEMS die. The second plurality of drive waveform data can be temporally delayed until the falling portion, e.g., the portion of the pulse where current is supplied from a low voltage supply, of the pulse of the first plurality of drive waveform data is complete. This temporal delay can help provide that the first plurality of generated drive waveforms and the second plurality of generated drive waveforms are not drawing current from the low voltage supply simultaneously. Similarly, because the falling portion of the second plurality of drive waveform data is temporally delayed, e.g., offset from, relative to the falling portion of the first plurality of drive waveform data, the rising portion of the second plurality of drive waveform data is also temporally delayed relative to the rising portion of the first plurality of drive waveform data. Therefore the temporal delay can also help provide that the first plurality of generated drive waveforms and the second plurality of generated drive waveforms are not drawing current from the high voltage supply simultaneously. Advantageously, because there is a reduced draw of power from the low voltage source and/or the high voltage source, piezoelectric printhead assemblies according to the present disclosure and printing systems having such assemblies may utilized a reduced bulk capacitor load, a reduced power supply, and/or circuitry to handle a reduced power demand, as compared to other printhead assemblies and/or printing systems.

In various examples, the method can include providing a third plurality of respective generated drive waveforms via a third arbitrary waveform data generator to a third number of nozzles of the MEMS die wherein the third plurality of respective generated drive waveforms is temporally delayed from the second plurality of respective generated drive waveforms. Some examples of the present disclosure provide that current supplied from the low voltage supply for the third plurality of respective generated drive waveforms does not overlap with either current supplied from the low voltage supply for the second plurality of respective generated drive waveforms or current supplied from the low voltage supply for the first plurality of respective generated drive waveforms. Similarly, some examples of the present disclosure provide that current supplied from the high voltage supply for the third plurality of respective generated drive waveforms does not overlap with either current supplied from the high voltage supply for the second plurality of respective drive waveform data or current supplied from the high voltage supply for the first plurality of respective generated drive waveforms. Some examples of the present disclosure provide that the third plurality of respective generated drive waveforms are generated by a second arbitrary waveform data generator of the first ASIC die wire bonded to the MEMS die. As discussed, providing temporal delay can help provide a reduced draw of power from the low voltage source and/or the high voltage source.

In various examples, the method can include providing a fourth plurality of respective generated drive waveforms via a fourth arbitrary waveform data generator to a fourth number of nozzles of the MEMS die, wherein the fourth plurality of respective generated drive waveforms is temporally delayed from the third plurality of respective generated drive waveforms. Some examples of the present disclosure provide that current supplied from the low voltage supply for the fourth plurality of respective generated drive waveforms does not overlap with current supplied from the low voltage supply for the third plurality of respective generated drive waveforms, current supplied from the low voltage supply for the second plurality of respective generated drive waveforms, or current supplied from the low voltage supply for the first plurality of respective generated drive waveforms. Similarly, some examples of the present disclosure provide that current supplied from the high voltage supply for the fourth plurality of respective generated drive waveforms does not overlap with current supplied from the high voltage supply for the third plurality of respective generated drive waveforms, current supplied from the high voltage supply for the second plurality of respective generated drive waveforms, or current supplied 481 from the high voltage supply for the first plurality of respective generated drive waveforms. Some examples of the present disclosure provide that the fourth plurality of respective generated drive waveforms are generated by a second arbitrary waveform data generator of the second ASIC die wire bonded to the MEMS die. As discussed, providing temporal delay can help provide a reduced draw of power from the low voltage source and/or the high voltage source.

The specification examples provide a description of the piezoelectric printhead assemblies and method of the present disclosure. Since many examples can be made without departing from the spirit and scope of the system and method of the present disclosure, this specification sets forth some of the many possible example configurations and implementations.

In the detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be used and the process, electrical, and/or structural changes may be made without departing from the scope of the present disclosure.

The figures herein follow a numbering convention in which the first digit or digits correspond to the drawing figure number and the remaining digits identify an element or component in the drawing. Elements shown in the various examples herein can be added, exchanged, and/or eliminated so as to provide a number of additional examples of the present disclosure.

In addition, the proportion and the relative scale of the elements provided in the figures are intended to illustrate the examples of the present disclosure, and should not be taken in a limiting sense. As used herein, "a number of" an entity, an element, and/or feature can refer to one or more of such entities, elements, and/or features.

What is claimed:

1. A piezoelectric fluid ejection assembly, comprising:

a micro-electro mechanical system (MEMS) die including a plurality of nozzles;

a first application-specific integrated circuit (ASIC) die electrically connected to the MEMS die, the first ASIC die comprising:

a plurality of driver amplifiers for respective nozzles of a first number of the plurality of nozzles, and a plurality of unique waveform data generators to generate respective different waveforms for activating the nozzles of the first number of the plurality of nozzles; and a second ASIC die electrically connected to the MEMS die, the second ASIC die comprising:

a plurality of driver amplifiers for respective nozzles of a second number of the plurality of nozzles, and a plurality of unique waveform data generators to generate respective different waveforms for activating the nozzles of the second number of the plurality of nozzles.

2. The piezoelectric fluid ejection assembly of claim 1, wherein the first ASIC die and the second ASIC die share a single design.

3. The piezoelectric fluid ejection assembly of claim 2, wherein the second ASIC die is rotated one hundred eighty degrees relative to the first ASIC die.

4. The piezoelectric fluid ejection assembly of claim 1, wherein the plurality of nozzles are arranged in a two dimensional array.

5. The piezoelectric fluid ejection assembly of claim 1, wherein the first ASIC die includes a selector to select one of the plurality of unique waveform data generators of the first ASIC die to generate a respective waveform for activating a nozzle of the first number of the plurality of nozzles.

6. The piezoelectric fluid ejection assembly of claim 5, wherein the piezoelectric fluid ejection assembly is a printhead assembly, and the selecting by the selector is based on pixel data.

7. The piezoelectric fluid ejection assembly of claim 5, wherein the first ASIC die includes a scaler to scale a waveform produced by one of the plurality of unique waveform data generators of the first ASIC die, the scaling based on calibration of a corresponding nozzle of the first number of the plurality of nozzles.

8. The piezoelectric fluid ejection assembly of claim 1, wherein the first ASIC die includes a plurality of digital-to-analog converters to convert digital streams based on waveforms from the waveform data generators of the first ASIC die to analog signals that are provided to the plurality of driver amplifiers of the first ASIC die.

9. The piezoelectric fluid ejection assembly of claim 1, wherein the MEMS die has a nozzle density of at least 1,200 nozzles per inch.

10. A piezoelectric printhead assembly comprising:

a micro-electro mechanical system (MEMS) die including a plurality of nozzles arranged in a two dimensional array;

a first application-specific integrated circuit (ASIC) die electrically connected to the MEMS die, the first ASIC die comprising a plurality of unique waveform data generators to generate respective different waveforms for activating nozzles of a first number of the plurality of nozzles; and a second ASIC die electrically connected to the MEMS die, the second ASIC die comprising a plurality of unique waveform data generators to generate respective different waveforms for activating nozzles of a second number of the plurality of nozzles.

11. The piezoelectric printhead assembly of claim 10, wherein the first ASIC die utilizes a respective scaling value for each of the first number of the plurality of nozzles of the MEMS die.

12. The piezoelectric printhead assembly of claim 10, wherein the first ASIC die is adjacent a first side of the MEMS die, and the second ASIC die is adjacent a second side of the MEMS die.

13. The piezoelectric printhead assembly of claim 12, wherein a planar cross section of the MEMS die is located entirely between the first ASIC die and the second ASIC die, wherein the planar cross section is perpendicular to the first side of the MEMS die and the second side of the MEMS die.

14. The piezoelectric printhead assembly of claim 10, wherein the first ASIC die and the second ASIC die share a single design.

15. The piezoelectric printhead assembly of claim 10, wherein the first ASIC die includes a selector to select one of the plurality of unique waveform data generators of the first ASIC die to generate a respective waveform for activating a nozzle of the first number of the plurality of nozzles.

16. The piezoelectric printhead assembly of claim 15, wherein the selecting by the selector is based on pixel data.

17. A method comprising:

providing a first plurality of respective generated drive waveforms via a first arbitrary waveform data generator to a first number of nozzles of a micro-electro mechanical system (MEMS) die, wherein the first plurality of respective generated drive waveforms are generated by a first arbitrary waveform data generator of a first application-specific integrated circuit (ASIC) die electrically connected to the MEMS die, the first arbitrary waveform data generator selected from a plurality of different waveform data generators on the first ASIC die; and providing a second plurality of respective generated drive waveforms via a second arbitrary waveform data generator to a second number of nozzles of the MEMS die, wherein the second plurality of respective generated drive waveforms is temporally delayed from the first plurality of respective generated drive waveforms.

18. The method of claim 17, wherein the second plurality of respective generated drive waveforms are generated by a first arbitrary waveform data generator of a second ASIC die electrically connected to the MEMS die, the first arbitrary waveform data generator of the second ASIC die selected from a plurality of different waveform data generators on the second ASIC die.

19. The method of claim 17, further comprising providing a third plurality of respective generated drive waveforms via a third arbitrary waveform data generator to a third number of nozzles of the MEMS die, wherein the third plurality of respective generated drive waveforms are temporally delayed from the second plurality of respective generated drive waveforms.

20. The method of claim 17, wherein the selecting of the first arbitrary waveform data generator from the plurality of different waveform data generators on the first ASIC die is based on pixel data that has been printed or is to be printed.

* * * * *